US007718534B2

(12) United States Patent
Martinez et al.

(10) Patent No.: US 7,718,534 B2
(45) Date of Patent: May 18, 2010

(54) PLANARIZATION OF A HETEROEPITAXIAL LAYER

(75) Inventors: Muriel Martinez, Saint Egreve (FR); Frédéric Metral, Saint Hilaire du Touvet (FR); Patrick Reynaud, Saint Martin d'Heres (FR); Zohra Chahra, Meylan (FR)

(73) Assignee: S.O.I.Tec Silicon on Insulator Technologies, Bernin (FR)

( * ) Notice: Subject to any disclaimer, the term of this patent is extended or adjusted under 35 U.S.C. 154(b) by 755 days.

(21) Appl. No.: 11/608,030

(22) Filed: Dec. 7, 2006

(65) Prior Publication Data

US 2007/0087570 A1 Apr. 19, 2007

Related U.S. Application Data

(63) Continuation-in-part of application No. PCT/EP2004/006186, filed on Jun. 8, 2004.

(51) Int. Cl.
*H01L 21/302* (2006.01)

(52) U.S. Cl. ..... 438/692; 257/E21.304

(58) Field of Classification Search ..... 257/E21.304; 438/692

See application file for complete search history.

(56) References Cited

U.S. PATENT DOCUMENTS

| | | | | |
|---|---|---|---|---|
| 6,475,072 | B1 | 11/2002 | Canaperi et al. | 451/65 |
| 6,524,935 | B1 | 2/2003 | Canaperi et al. | 438/478 |
| 7,641,540 | B2 * | 1/2010 | Ono et al. | 451/526 |
| 2004/0055223 | A1 * | 3/2004 | Ono et al. | 51/293 |
| 2004/0083068 | A1 * | 4/2004 | Tseng et al. | 702/77 |
| 2005/0076581 | A1 * | 4/2005 | Small et al. | 51/307 |
| 2007/0224919 | A1 * | 9/2007 | Li et al. | 451/41 |

FOREIGN PATENT DOCUMENTS

| | | | |
|---|---|---|---|
| WO | WO 98/59365 | A1 | 12/1998 |
| WO | WO 02/082514 | A1 | 10/2002 |

OTHER PUBLICATIONS

"Rodel® IC 1000 CMP Pad", 1999, Rodel, 2 pages.
K. Sawano et al., "Surface smoothing of SiGe strain-relaxed buffer layers by chemical mechanical polishing", 2002, Materials Science and Engineering B89, pp. 406-409.
K. Sawano et al., "Planarization of SiGe virtual substrates by CMP and its application to strained Si modulation-doped structures", 2003, Journal of Crystal Growth 251, pp. 693-696.
"Electronic Materials", 2004, Rohm and Haas Electronic Materials, 1 page.

* cited by examiner

*Primary Examiner*—Thao P. Le
(74) *Attorney, Agent, or Firm*—Winston & Strawn LLP

(57) ABSTRACT

A method of planarization of a surface of a heteroepitaxial layer by chemical-mechanical polishing the disturbed surface of the heteroepitaxial layer with a polishing pad having a compressibility greater than 2% and less than 15% and a slurry comprising at least 20% of silica particles having an average diameter between about 70 and about 100 nm. This method allows to reach high polishing rates appropriated for eliminating surface defects on heteroepitaxial layers, such as crosshatch patterns, and to achieve, in the same time, a final polish that is desirable to facilitate further operations.

20 Claims, 4 Drawing Sheets

PLANARIZATION OF A HETEROEPITAXIAL LAYER

CROSS REFERENCE TO RELATED APPLICATION

This application is a continuation-in-part of International Application PCT/EP2004/006186 filed Jun. 8, 2004, the entire content of which is expressly incorporated by reference herein.

FIELD OF THE INVENTION

The present invention relates to the field of heterostructures that include a relaxed buffer layer epitaxially grown on a substrate of a different material. More precisely, the invention is directed to the polishing techniques which are implemented for such structures either for eliminating crosshatch patterns that occur during growth from the dislocation strain fields, or for smoothing the final surface after a transfer process has been performed detach a layer from a donor substrate for transfer to a handle or support substrate.

BACKGROUND OF THE INVENTION

A typical example of a heterogeneous structure is the $Si_{(1-x)}Ge_{(x)}$ structure which includes a relaxed $Si_{(1-x)}Ge_{(x)}$ buffer layer that is epitaxially grown on a Si substrate. Such a heterogeneous structure is described in the paper entitled "Planarization of SiGe virtual substrate by CMP and its application to strained Si modulation-doped structures", by K. Sawano et al, published in Journal of Crystal Growth, V251, pp 693-696 (2003). As shown in FIG. 1 herein, such a heterostructure 100 comprises a strained relaxed $Si_{(1-x)}Ge_{(x)}$ buffer layer 105, which consists of a compositionally step-graded $Si_{(1-x)}Ge_{(x)}$ (x=0–0.3) layer 102 (300 nm) and uniform $Si_{(0.7)}Ge_{(0.3)}$ layer 103 (1 μm), that is grown on a p-type Si substrate 101.

As a result of the lattice constant mismatch between the substrate and subsequent layers, a relaxation crosshatch pattern 104 is created at the top surface. FIG. 2 shows an image of the surface morphology of a strain-relaxed SiGe buffer layer performed by an atomic force microscope (AFM). The crosshatch exhibits an initial roughness of 3.2 nm, with a peak-valley of 21.2 nm, for a scan area of 40*40 μm. Thus, surface variations associated with this crosshatch pattern must be minimized by appropriate polishing prior to further epitaxy, such as, for example, before growing the $Si_{(0.7)}Ge_{(0.3)}$ buffer layer (100 nm), Si channel layer (15 nm) and $Si_{(0.7)}Ge_{(0.3)}$ spacer layer (20 nm).

After this donor wafer is fabricated, a transfer process is performed in order to detach and transfer a part of the upper layer(s) from this "engineered" substrate to a handle substrate. An example of such a transfer process is the SMART-CUT® technology which is described notably in the article by A. J. Auberton-Hervé et al entitled "Why can Smart Cut change the future of microelectronics?", Int. Journal of High Speed Electronics and Systems, Vol. 10, no. 1, 2000, pp 131-146. This approach implements an ion implantation step to create a weakened or cleavage zone in the donor wafer, and bonding the implanted face of that wafer to a handle substrate, followed by mechanical detachment or cleaving of a useful layer from the donor wafer. The mechanical detachment results in a damaged zone on the final top surface which must be polished in order to obtain the required smoothness for the useful layer.

During the recycling of silicon or $Si_{(1-x)}Ge_{(x)}$ donor substrates after conducting such a transfer process, polishing processes are implemented to decrease the surface roughness and eliminate the damaged zone of the donor wafer that is to be recycled. In this case, the polishing is performed in one or several steps (including a planarization step followed by a finishing step).

These situations are all characterized by a disturbed zone (crosshatch pattern in the first case, or of after-detachment residues in the other cases), of a given thickness, existing on a substrate, which has to be eliminated or smoothened. Techniques for eliminating crosshatch patterns and reducing the surface roughness of $Si_{(1-x)}Ge_{(x)}$ substrates have been previously reported by K. Sawano et al. in Journal of Crystal Growth, as mentioned above, and in Material and Science Engineering, in a paper entitled "Surface smoothing of SiGe strain-relaxed buffer layers by chemical mechanical polishing" (B89, pp 406-409, 2002). A roughness of root mean square (RMS) values less than 1 nm (around 0.4 nm over 10*10 $\mu m^2$ surfaces) after polishing the $Si_{(1-x)}Ge_{(x)}$ substrate is reported. However, the polishing rates achieved for this kind of process are relatively slow, namely, a maximum polishing rate of only 13 Å/sec is obtained.

Moreover, the finishing process of a silicon layer of a Si-on-insulator (SOI) material by chemical-mechanical polishing, such as disclosed in U.S. Pat. No. 6,988,936, as well as that for the recycling of a silicon peeled wafer such as disclosed in the Japanese patent publication JP-A-11 297583, are not appropriate to materials such as SiGe material because the polishing rate is too slow. In particular, the $Si_{(1-x)}Ge_{(x)}$ polishing rate is lower by a factor of 5 versus that for polishing Si. Accordingly, improved polishing processes for such materials is needed, and these are now provided by the present invention.

SUMMARY OF THE INVENTION

The present invention relates to a method for planarization of disturbed surfaces (e.g., crosshatch patterns or after-detachment residues) of heteroepitaxial layer materials, such as SiGe, to increase the polishing rate of such materials while reducing the surface roughness in a minimum time period. As noted above, a preferred method of planarization of a surface of a heteroepitaxial layers includes a step of chemical-mechanical polishing the surface of the heteroepitaxial layer with a polishing pad having a compressibility greater than 2% and less than 15% and a slurry comprising at least 20% of silica particles having an average diameter between about 70 and about 100 nm. Preferably, the heteroepitaxial layer is a SiGe layer. This heteroepitaxial layer is generally formed on a strain-relaxed buffer layer grown on a silicon substrate and can have crosshatch pattern at its surface, which patters is easily removed by this polishing technique.

BRIEF DESCRIPTION OF THE DRAWINGS

The invention and its advantages will be better understood from the following description, given as non-limiting examples, of preferred embodiments with reference to the appended drawings, in which.

DETAILED DESCRIPTION OF THE PREFERRED EMBODIMENTS

Figure 1:
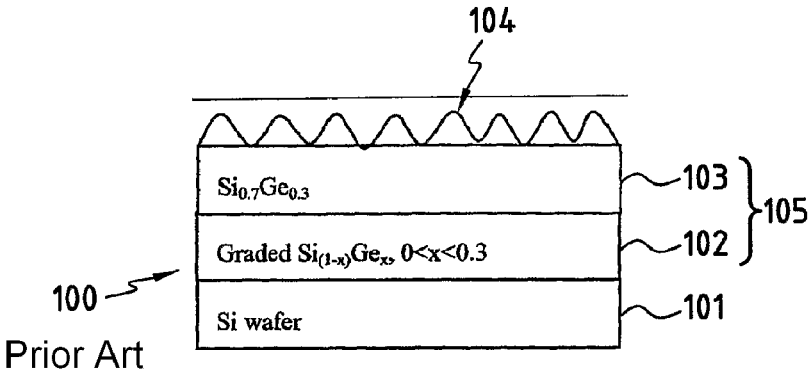
FIG. 1 is a schematic cross-sectional view of a prior art structure that includes a relaxed SiGe layer epitaxially grown on a Si substrate.
Figure 2:
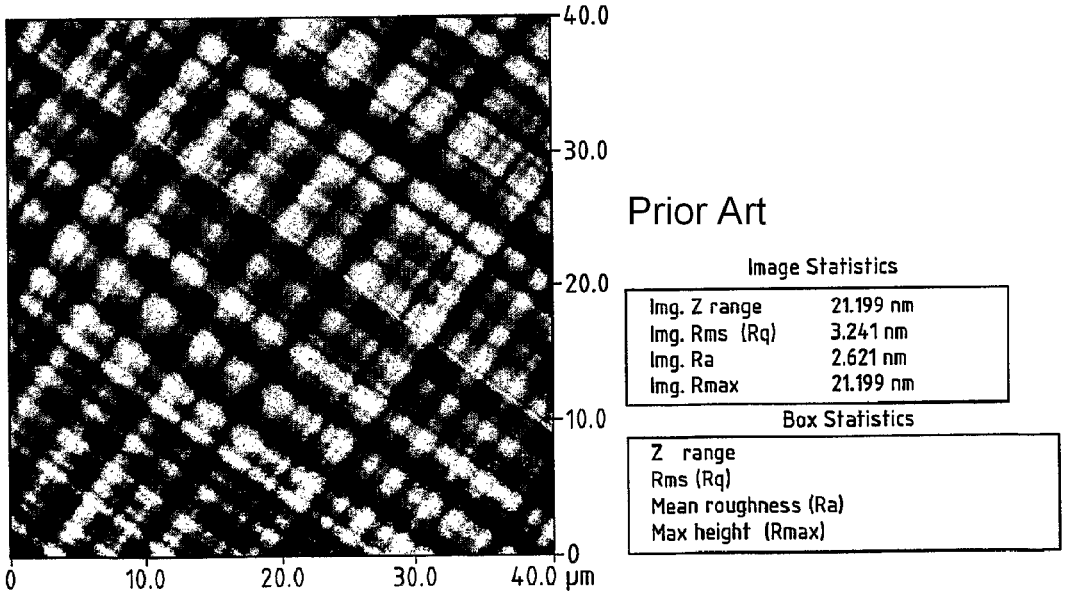
FIG. 2 is an image of the surface morphology of a prior art strain-relaxed SiGe buffer layer performed by an atomic force microscope (AFM)

The chemical-mechanical polishing is preferably conducted using a polishing tool having a head velocity Vt, a platen velocity Vp, and a polishing pressure P. In a preferred embodiment, the polishing tool is adjusted such that ratio of Vt to Vp is approximately equal to about 1 and 2 and in particular around 1.5 (or 46 rpm/30 rpm), at a polishing pressure P of about 1 to 11 psi and preferably 6 psi so as to reach a stabilized polishing rate around 30 to 50 Å/sec and typically 40 Å/sec, as such parameters are highly appropriate for eliminating surface defects on heteroepitaxial layers, such as crosshatch patterns. The step of chemical mechanical polishing is advantageously carried out for a period of 4 minutes or less and preferably for less than 200 seconds. This process conveniently removes a thickness of about 500 nm of the crosshatch pattern during this step. In this embodiment, these parameters can be adjusted to facilitate a polishing rate in the range of about 35 Å/sec to about 45 Å/sec. For this embodiment, the parameters are adjusted to include one of the following groups: {Vt≈46 rpm, Vp≈30 rpm, and 5<P<7 psi}, {P≈6 psi, Vp≈30 rpm, and 40<Vt<55 rpm}, {P≈6 psi, Vt≈46 rpm, and 25<Vp<35 rpm}.

In another embodiment, when a lesser thickness of material is to be eliminated, the chemical-mechanical polishing can be carried out after detachment of part of the heteroepitaxial layer and is conducted to smooth the detached or fractured surface of the heteroepitaxial layer. The head velocity Vt, platen velocity Vp, and pressure P of the polishing tool are beneficially adjusted such that ratio of Vt to Vp is between 1 and 1.5 and typically is approximately equal to 1.2 (or 36 rpm/30 rpm) with the polishing pressure P being about 1 to 5 and preferably 3 psi so as to reach a stabilized polishing rate of 10 or 15 to 30 Å/sec and preferably around 18 Å/sec. The step of chemical mechanical polishing is advantageously carried out for a period of one minute or less and preferably less than 50 seconds. Preferably, the thickness of the fractured surface removed during this step is between about 50 nm and about 130 nm. For this embodiment, the three above parameters can be adjusted so as to facilitate polishing rate in the range of about 15 Å/sec to about 25 Å/sec. For this embodiment, the parameters are adjusted to include one of the following groups: {Vt≈36 rpm, Vp≈30 rpm, and 2.5<P<5 psi}, {P≈3 psi, Vp≈30 rpm, and 33<Vt<58 rpm}, {P≈3 psi, Vt≈36 rpm, and 18<Vp<36 rpm}

The most preferred polishing pad for use in the chemical mechanical polishing of the heteroepitaxial layer preferably has a compressibility of around 4 to 10% and typically around 6%. Advantageously, the roughness level of the surface of the heteroepitaxial layer after the step of chemical-mechanical polishing is less than about 0.2 nm RMS.

Figure 3:
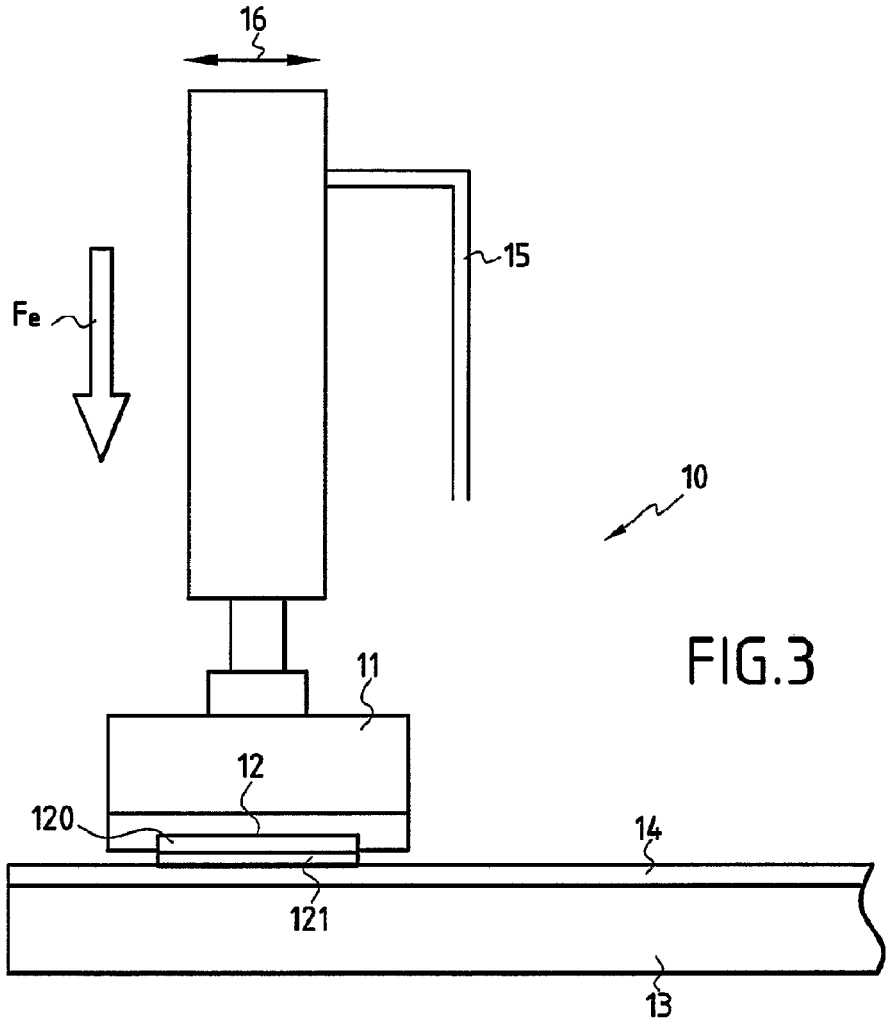
FIG. 3 is a schematic of an apparatus for polishing according to an embodiment of the invention.

FIG. 3 illustrates a system 10 according to an embodiment of the invention which can be used for implementing the method of the present invention. The system 10 comprises a polishing head 11 into which a structure 12 to be polished is inserted and a plate 13 covered with a polishing pad 14. A liquid abrasive or slurry is injected into the head, for example via a side conduit 15. A polishing pressure Fe and a movement represented by an arrow 16 are applied to the head 11 to carry out polishing.

The structure 12 is a heterostructure comprising at least a heteroepitaxial layer 121, as for example a SiGe layer, which has grown on a substrate 120 of another material such as silicon. The surface of the heteroepitaxial layer 121 is polished in order to eliminate crosshatch patterns occurred during growth from the dislocation strain fields, or for smoothing the final surface disturbed after a transfer process using a substrate fracture method (e.g., SMART-CUT®) has been performed (after-cleaving residues).

According to the present invention, chemical-mechanical polishing (CMP) is carried out with an intermediate polishing pad, that is a pad having a compressibility rate less than that of a soft pad and more than a hard pad. More precisely, the polishing pad used in the invention has a compressibility rate included between 2% (hard pad) and 15% (soft pad), preferably around 6%.

The CMP is also performed by an "aggressive" slurry containing a colloidal solution, such as a $NH_4OH$ solution, with high rate of silica, namely more than 20% to as much as 100% with 20 to 30% being preferred. Also, the silica particles preferably have a size in 70-100 nm range.

The combined use of the above-mentioned intermediate pad and aggressive slurry allows to perform CMP which are suitable to the polishing of heteroepitaxial layers, such as $Si_{(1-x)}Ge_{(x)}$ layers, permitting, on the one hand, to eliminate either the surface defects (crosshatch patterns and after-cleaving residues), and, on the other hand, to achieve a final post bonding polish to roughness values less than 0.4 nm RMS, over 10*10 μm area, while preserving an industrial, cost effective process.

The polishing pad used in the invention is primarily intended for smoothing the surface, while the slurry with a high rate of silica enhances the reactive and mechanical activity of the etching and hence allows to increase the polishing rate for $Si_{(1-x)}Ge_{(x)}$.

Figure 4A:
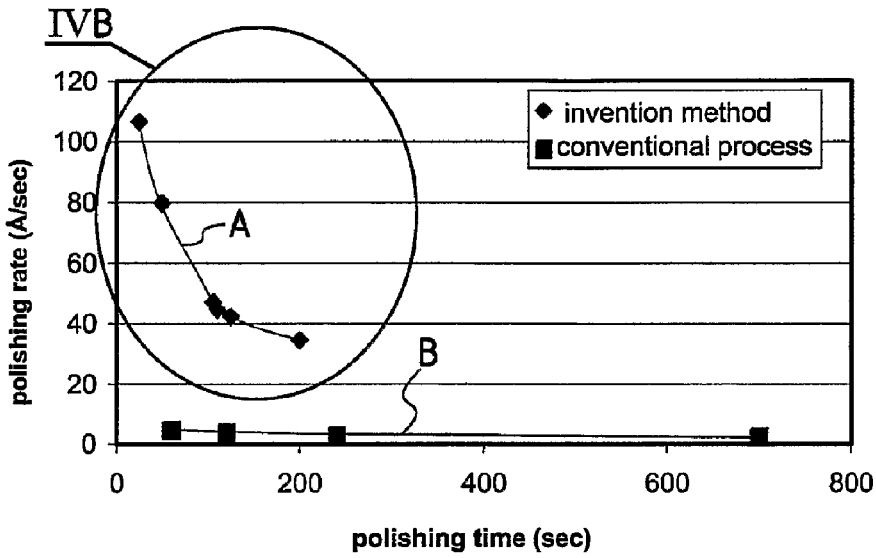
FIGS. 4A and 4B are curves showing polishing rate variation according to polishing time which are obtained with the method of the invention and with a conventional method.

The advantages of the planarization method of the present invention become apparent when comparing the polishing rate obtained with typical processes used for silicon polishing, such as disclosed in U.S. Pat. No. 6,988,936, with that obtained with the planarization method of the invention. FIG. 4A shows the polishing rate according to polishing time which is obtained with a typical process (curve B) used for silicon polishing (soft pad of around 10% compressibility, "standard" slurry including a colloidal solution with a low rate of silica (less than 10%) and silica particles of 130-210 nm in diameter), here applied to SiGe polishing, and with the planarization method of the invention (i.e., CMP with intermediate pad stiffness of 6% compressibility, "aggressive" slurry including at least 20% of silica particles having a size comprised between 70 and 100 nm) (curve A). The results shown in FIG. 4A are obtained from SiGe samples which consist of $Si_{0.8}Ge_{0.2}$ wafers.

FIG. 4A clearly shows the advantages of the planarization method of the invention for the polishing rate on $Si_{(1-x)}Ge_{(x)}$ since it permits to reach a polishing rate of around 40 Å/sec, versus 2 Å/sec with the typical process.

As a result, the processing duration is very short, less than 200 seconds in order to eliminate a crosshatch pattern of a thickness around 500 nm and prepare surface for bonding.

Figure 4B:
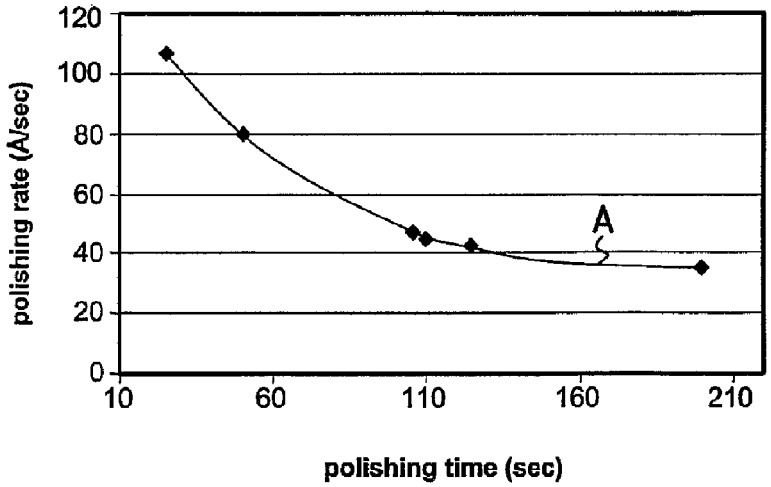

FIG. 4B which is an enlarged view of the curve A of FIG. 4A, indicates that the polishing rate decreases along with time and stabilizes from around 130 seconds to about 40 Å/sec, a value well suitable for large material removal such as required by crosshatch pattern removal. Such a stabilization insures also a good process reproducibility.

The stabilized polishing rate of 40 Å/sec can be obtained by adjusting the parameters of the polishing tool. For instance, a stabilized polishing rate around 40 Å/sec can be reached when the Vt, Vp parameters (Vt=head velocity and Vp=platen velocity) of the polishing tool, such as that provided in Strasbaugh's 6DS-SP CMP Systems, are set such that Vt/Vp=46/30 rpm with a polishing pressure P of 6 psi. In the same way, in order to have a polishing rate comprised in the range 35 Å/sec to 45 Å/sec, the three above parameters can be adjusted according to the following possibilities:

if Vt and Vp are constant (i.e. Vt=46 rpm and Vp=30 rpm) then 5<P<7 psi, if P and Vp are constant (i.e. P=6 psi and Vp=30 rpm) then 40<Vt<55 rpm, and if P and Vt are constant (i.e. P=6 psi and Vt=46 rpm) then 25<Vp<35 rpm.

Figure 5:
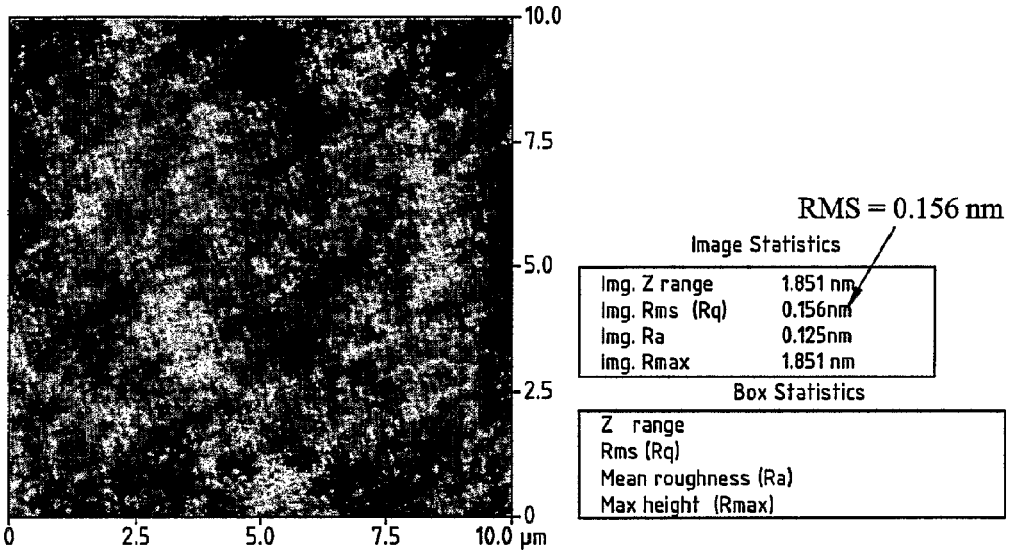
FIG. 5 is an AFM image of the surface morphology of a SiGe layer after polishing according to an embodiment of the invention.

Moreover, this polishing process allows to get roughness levels of less than 0.2 nm RMS (over 10*10 $\mu m^2$ surfaces), as it is apparent from FIG. 5 which is an AFM image of the surface morphology of a $Si_{(1-x)}Ge_{(x)}$ layer after polishing performed (at a polishing rate of 40 Å/sec) for eliminating the crosshatch pattern and preparing surface for bonding.

In case of final polishing after the transfer of the $Si_{(1-x)}Ge^{(x)}$ layer to the insulating substrate, the thickness to be removed, from 50 nm to 130 nm, is much less important than for the crosshatch elimination, so that the parameters can be adapted in order to get also a good process reproducibility.

Figure 6:
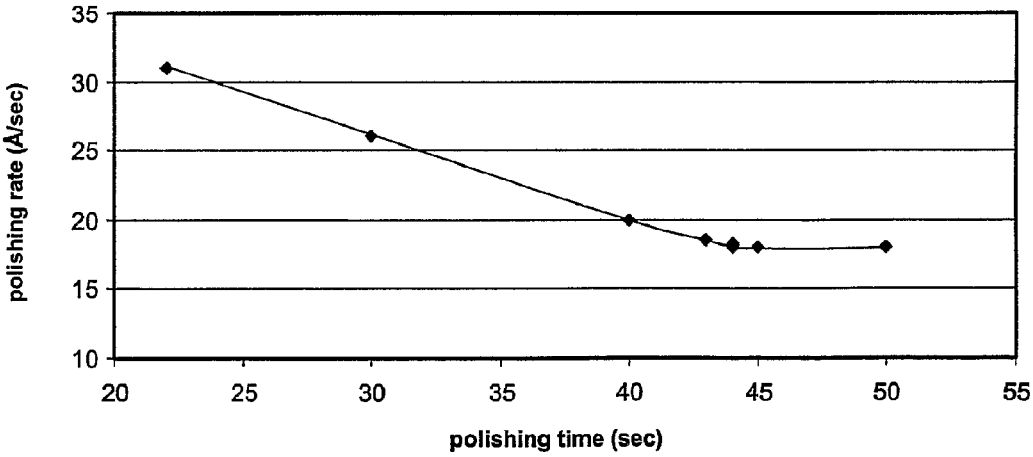
FIG. 6 is a curve showing polishing rate variation according to polishing time in accordance with an embodiment of the invention.

The corresponding polishing rate variation according to polishing time is shown on FIG. 6, that is, from around 45 seconds, the polishing rate is stabilized to 18 Å/sec. The stabilized polishing rate of 18 Å/sec can be obtained by adjusting the parameters of the polishing tool. For instance, a stabilized polishing rate around 18 Å/sec can be reached when the Vt, Vp parameters (Vt=head velocity and Vp=platen velocity) of the polishing tool, such as that provided in Strasbaugh's 6DS-SP CMP Systems, are set such that Vt/Vp=36/30 rpm with a polishing pressure P of 3 psi. In the same way, in order to have a polishing rate comprised in the range 15 Å/sec to 25 Å/sec, the three above parameters can be adjusted according to the following possibilities:

if Vt and Vp are constant (i.e. Vt=36 rpm and Vp=30 rpm) then 2.5<P<5 psi, if P and Vp are constant (i.e. P=3 psi and Vp=30 rpm) then 33<Vt<58 rpm, and if P and Vt are constant (i.e. P=3 psi and Vt=36 rpm) then 18<Vp<36 rpm.

Figure 7:
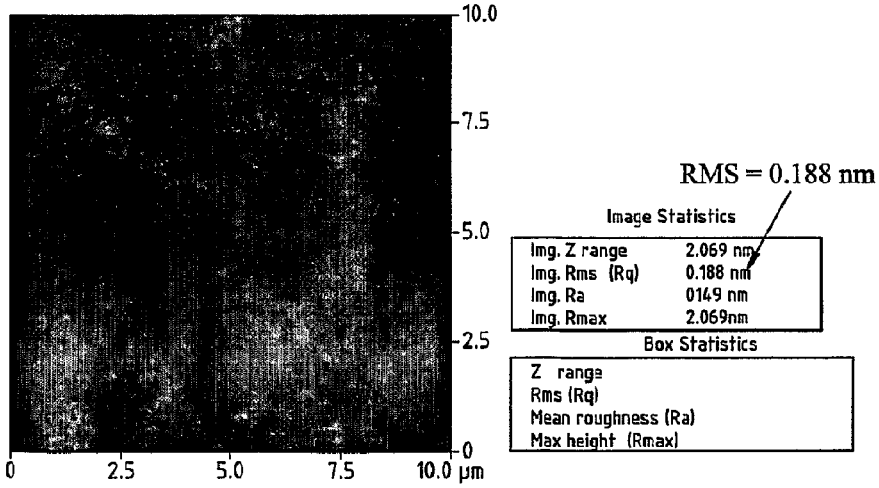
FIG. 7 is an AFM image of the surface morphology of a SiGe layer after polishing according to an embodiment of the invention.

After this final polishing, an ultra low level of roughness is achieved, namely 0.19 nm RMS with a peak-valley of 2.1 nm (scan area 10*10 $\mu m^2$) as shown on FIG. 7 which is an AFM image of the surface morphology of a $Si_{(1-x)}Ge_{(x)}$ layer (polished at a polishing rate of 18 Å/sec as in FIG. 6).

Such ultra-smooth surfaces are well fitted for applications such as epitaxy regrowth or molecular bonding in view of high end Si-LSI production.

To summarize, by using, for polishing heteroepitaxial layers as $Si_{(1-x)}Ge_{(x)}$ layers, more appropriate both pad stiffness grade and silica colloidal solutions, the invention allows to get surface roughness values for as good as a usual final polishing processes, but in a much shorter time. A short time then insures to minimize major defects, such as scratches, which often occur for long polishing times. Consequently, the process is better adapted for mass production. Accordingly also, it is cost effective since performed in a one-step process and limits the related disposable materials.

What is claimed is:

1. A method for planarizing a disturbed surface of a heteroepitaxial layer which comprises chemical-mechanical polishing of the surface using a polishing pad having a compressibility that is greater than 2% but less than 15%, after applying to the surface a slurry comprising at least 20% of silica particles having an average diameter between about 70 nm and about 100 nm, with the polishing conducted with a stabilized polishing rate of at least 10 Å/sec to rapidly remove undesired surface material of the heteroepitaxial layer.

2. The method of claim 1, wherein the heteroepitaxial layer is a SiGe layer.

3. The method of claim 2, wherein the disturbed surface is obtained by forming the heteroepitaxial layer on a strain-relaxed buffer layer grown on a silicon substrate, with the heteroepitaxial layer having a crosshatch pattern at its surface due to lattice constant mismatch.

4. The method of claim 3, wherein the chemical-mechanical polishing is conducted with a polishing tool having parameters including a head velocity Vt, a platen velocity Vp, and a polishing pressure P which parameters are adjusted to achieve the stabilized polishing of the heteroepitaxial layer.

5. The method of claim 4, wherein the parameters of the polishing tool are adjusted such that ratio of Vt to Vp is between 1 and 2 with the polishing pressure P between about 3 and 10 psi so as to reach a stabilized polishing rate of around 30 to 50 Å/sec.

6. The method of claim 5, wherein the step of chemical mechanical polishing is carried out for a period 4 minutes or less.

7. The method of claim 5, wherein the parameters of the polishing tool are adjusted such that ratio of Vt to Vp is approximately equal to 1.5 or 46 rpm/30 rpm with the polishing pressure P about 6 psi so as to reach a stabilized polishing rate of around 40 Å/sec.

8. The method according to claim 7, wherein the step of chemical mechanical polishing is carried out for a period less than 200 seconds.

9. The method of claim 7, wherein the polishing eliminates a thickness of about 500 nm of the disturbed heteroepitaxial layer.

10. The method of claim 4, wherein the head velocity Vt, platen velocity Vp and polishing pressure P of the polishing tool are adjusted to include one of the following groups:

{Vt≈46 rpm, Vp≈30 rpm, and 5<P<7 psi}

{P≈6 psi, Vp≈30 rpm, and 40<Vt<55 rpm}

{P≈6 psi, Vt≈46 rpm, and 25<Vp<35 rpm} so as to obtain a polishing rate in the range of about 35 Å/sec to about 45 Å/sec.

11. A method transferring a heteroepitaxial layer from a donor substrate to a handle substrate by a layer transfer technique with the transferred heteroepitaxial layer having a disturbed surface as a result of the transfer; applying to the surface of the transferred heteroepitaxial layer a slurry comprising a $NH_4OH$ solution containing at least 20% of silica particles having an average diameter between about 70 nm and about 100 nm; and planarizing the disturbed surface of the heteroepitaxial layer by chemical-mechanical polishing of the surface using a polishing pad having a compressibility that is greater than 2% but less than 15%, with the polishing conducted with a stabilized polishing rate of at least 10 Å/sec to rapidly remove undesired surface material of the heteroepitaxial layer.

12. The method of claim 11, wherein the parameters of the polishing tool are adjusted such that ratio of Vt to Vp is between 1 and 1.5 with the polishing pressure P of about 1 to 5 psi so as to reach a stabilized polishing rate around 10 to 30 Å/sec.

13. The method of claim 12, wherein the step of chemical mechanical polishing is carried out for a period of less than one minute.

14. The method of claim 11, wherein the parameters of the polishing tool are adjusted such that ratio of Vt to Vp is approximately equal to 1.2 or 36 rpm/30 rpm with a polishing pressure P of about 3 psi so as to reach a stabilized polishing rate around 18 Å/sec.

15. The method of claim 14, wherein the step of chemical mechanical polishing is carried out for less than 50 seconds.

16. The method of claim 14, wherein the thickness of the fractured surface removed during the step of chemical mechanical polishing is between about 50 nm and about 130 nm.

17. The method of claim 11, wherein the head velocity Vt, platen velocity Vp and polishing pressure P of the polishing tool are adjusted to include one of the following groups:

$$\{Vt \approx 36 \text{ rpm}, Vp \approx 30 \text{ rpm}, \text{ and } 2.5 < P < 5 \text{ psi}\}$$

$$\{P \approx 3 \text{ psi}, Vp \approx 30 \text{ rpm}, \text{ and } 33 < Vt < 58 \text{ rpm}\}$$

$$\{P \approx 3 \text{ psi}, Vt \approx 36 \text{ rpm}, \text{ and } 18 < Vp < 36 \text{ rpm}\}$$

so as to obtain a polishing rate in the range of about 15 Å/sec to about 25 Å/sec.

18. The method of claim 1, wherein the polishing pad has a compressibility of around 4 to 10%.

19. The method of claim 1, wherein the polishing pad has a compressibility of around 6%.

20. The method of claim 1, wherein the roughness level of the surface of the heteroepitaxial layer after the step of chemical-mechanical polishing is less than about 0.2 nm RMS.

* * * * *